US006230498B1

(12) United States Patent
Bin-Nun et al.

(10) Patent No.: US 6,230,498 B1
(45) Date of Patent: May 15, 2001

(54) INTEGRATED CRYOCOOLER ASSEMBLY WITH IMPROVED COMPRESSOR PERFORMANCE

(75) Inventors: Uri Bin-Nun, Keene, NH (US); Daniel L. Manitakos, Peabody, MA (US)

(73) Assignee: Inframetrics Inc., North Billerica, MA (US)

( * ) Notice: Subject to any disclaimer, the term of this patent is extended or adjusted under 35 U.S.C. 154(b) by 0 days.

(21) Appl. No.: 09/177,228

(22) Filed: Oct. 22, 1998

(51) Int. Cl.[7] ..... F25B 9/00
(52) U.S. Cl. ..... 62/6
(58) Field of Search ..... 62/6; 92/155, 212, 92/222, 223, 224

(56) References Cited

U.S. PATENT DOCUMENTS 4,577,549 * 3/1986 Frank et al. ..... 92/169
4,670,089 * 6/1987 Hanson ..... 156/629
4,858,442 8/1989 Stetson ..... 62/6

* cited by examiner

*Primary Examiner*—Corrine McDermott
*Assistant Examiner*—Malik N. Drake
(74) *Attorney, Agent, or Firm*—Edward L. Kelley

(57) ABSTRACT

A method for forming a mating piston and cylinder sleeve wherein the piston includes an outer diameter and a cylinder sleeve includes a bore for receiving the piston therein and wherein the piston outer diameter and the bore each form bearing surfaces having a gas film maintained in a gap therebetween. The method includes the steps of coating the piston outer diameter with a layer of PTFE based composite material and then diamond turning the piston outer diameter to a final piston diameter. The cylinder wall is also coated with a PTFE based composite layer which may be deposited by an electroless nickel plating process. The cylinder longitudinal bore is then diamond turned to a cylinder final diameter for mating with the piston final diameter.

40 Claims, 4 Drawing Sheets

INTEGRATED CRYOCOOLER ASSEMBLY WITH IMPROVED COMPRESSOR PERFORMANCE

RELATED APPLICATIONS

This application is related to and commonly assigned application Ser. No. 09/177,278, filed even dated herewith, entitled CRYOCOOLER REGNERATOR ASSEMBLY WITH MULTIFACETED COLDWELL WALL now U.S. Pat. No. 6,076,308.

FIELD OF THE INVENTION

This invention relates generally to the field of pistons and mating compression cylinder sleeves and especially to compressors operating in miniature integral Stirling cryocooler systems and particularly to a manufacturing method for making a compressor piston and mating cylinder bore.

BACKGROUND OF THE INVENTION

The need for cooling electronic devices such as infrared detectors to cryogenic temperatures is often met by miniature refrigerators operating on the Stirling cycle principle. As is well known, these cryogenic refrigerators or cryocoolers, use a motor driven compressor to impart a cyclical volume variation to a working volume filled with a pressurized refrigeration gas. The pressurized refrigeration gas is forced through the working volume to one end of a sealed cylinder called a cold well. A piston-shaped heat exchanger or regenerator is movably disposed inside the cold well. The regenerator includes passage ways to allow the refrigeration gas to enter and exit the cold well through the regenerator.

The regenerator reciprocates at a 90° phase shift relative to the compressor piston and the refrigeration gas is force to flow through the cold well in alternating directions. The refrigeration gas is thereby forced to flow from a compression space of the compressor through the regenerator passage ways and into the sealed cold well and then back. As the regenerator reciprocates, a warm end of the cold well which directly receives the refrigeration gas from the compressor becomes much warmer than the ambient. In the opposite end of the cold well, called the expansion space or cold end, the refrigeration gas expands and becomes much colder than the ambient. A device to be cooled is thus mounted adjacent to the expansion space, or cold end of the cold well such that thermal energy from the device to be cooled is passed to the refrigeration gas through a wall of the cold well.

It is a typical problem in the design of cryocooler compressor elements to minimize the amount of thermal energy generated by the operation of the compressor and further to avoid passing thermal energy from the compressor components to the refrigeration gas. It is also a problem in the design of cryocooler systems to improve the efficiency of the cryocooler so that the input power required to drive the compressor and regenerator pistons is reduced. This is especially true for cryocooler systems employed in portable hand held camera systems or other portable devices which typically operate under battery power.

It is known that proper selection of the radial clearance as well as reducing friction between a cryocooler compression piston and its mating compression cylinder bore can improve overall system efficiency and reduce thermal energy generated while operating the compressor. The goal of the compressor designer is to provide a uniform radial clearance between the compression piston and the compression cylinder wall. This allows the working gas to flow uniformly through the radial clearance or circumferencial gap surrounding the compression piston during a compression stroke so that a gas film uniformly supports the compression piston within the compression cylinder bore without contact with the cylinder wall. At the same time the pressure drop across the compression piston during a compression stroke of the piston should be minimized. It is therefore advantageous to have as small a radial gap as possible.

Using conventional manufacturing processes of first rough machining the compression piston and cylinder bore, then hardening the mating surfaces, e.g. by heat treating, then grinding and honing or lapping, the mating surfaces to a final dimension, small working clearances in the range of 50–75 micro inches are achievable. There is a general problem with the conventional techniques, however, that accurate geometry of the mating parts, specifically cylindricity of the piston outside diameter and the cylinder bore, is very difficult to achieve. Non-round and or non-cylindrical mating parts cause a non-uniform radial gap between the compressor piston and the cylinder wall which can lead to non-uniform gas pressure in the gap. This can lead to non-uniform loading of the piston against the cylinder wall causing locally increased friction and uneven wear. As a result, excess thermal energy is generated in the compressor and the energy required to drive the compressor is increased. The inability to maintain accurate part geometry by conventional techniques has forced manufacturers to resort to larger radial clearances than are desired.

It is also a problem that lapping and honing are hand operations which are difficult to automate. This results in increased manufacturing costs and cycle times. Another problem with conventional methods is that lapping compound residue can contaminate the cryocooler unit ultimately shortening the life of the unit. It is a further problem that prior art conventional manufacturing techniques are most suitable for use with steel whereas it is more desirable to manufacture compressor elements from aluminum or copper which have a higher thermal conductivity for more readily removing thermal energy from the working gas and the compressor.

It is known to reduced friction between the compressor piston and the mating cylinder wall by providing a layer of a hard, low friction machinable material over the mating surface of the compression piston. One such method applies a composite layer of bearing material in the form of a flexible tape bonded onto the mating surface of the piston. The flexible tape may include a polymetric reinforced layer of polytetrafluoroethylene (PTFE), however, other PTFE based composite materials may also be used. One such material is available under the trade name RULON J from DIXON DIVISION OF FURON of Bristol, R.I., USA. It is known in the art to bond a layer of RULON J tape to the piston mating surface.

RULON J as well as other PTFE based composite layers may be machined or ground after bonding onto the piston mating surface. In such applications, it is recommended to finish a mating cylinder wall with a relatively rough surface finish, e.g. 16 micro inches Ra, and then to wear in the PTFE based bearing material layer bonded to the piston mating surface by installing the piston into the mating cylinder and by cycling the piston over many hundreds or thousands of cycles. The mating pair is then disassembled, cleaned and reassembled for final manufacture. This process allows portions of the PTFE composite layer of bearing material bonded to the piston to penetrate the relatively rough cylinder wall thereby depositing a portion of the friction reducing layer into and onto the cylinder wall while at the same time smoothing the cylinder wall to a final surface finish during the wear in cycle. The wear in process although effective is undesirable since it adds time and labor to the overall manufacturing process. This process also reduces the overall life of the compressor since the wear-in process actually increases the clearance between the piston and the cylinder wall before the compressor is actually in use, thereby reducing its useful life.

It is therefore a general problem in the art to reduce the radial clearance between a cryocooler compression piston and its mating compression cylinder wall.

It is a further problem to manufacture cryocooler compression piston and compression cylinder elements with a high geometric accuracy for providing a more uniform radial clearance or circumferencial gap between the piston and cylinder wall mating surfaces.

It is a still further problem to reduce friction between a cryocooler compression piston and its mating cylinder wall so that compressor drive input power and heat generation are reduced.

It is still further problem to manufacture cryocooler compression pistons and cylinders from materials having a higher thermal conductivity than steel thereby more readily removing thermal energy from the compressor elements.

SUMMARY OF THE INVENTION

It is therefore a general object of the present invention to reduce radial clearance, improve geometric accuracy and reduce friction between a cryocooler compression piston and its mating cylinder wall elements. It is a further object of the present invention to manufacture compression pistons from materials having a higher thermal conductivity than steel as well as to reduce cost, labor and cycle time during manufacture of the cryocooler unit.

Accordingly, the present invention provides a method for forming a gas compressing apparatus or other apparatus having a mating piston and cylinder wall pair by the steps of forming a compression piston which includes a piston outer diameter, forming a mating or wear surface for mating with a cylinder wall, which is coated with a layer of PTFE based composite material and then diamond turned to a final piston diameter. It is noted that other coatings or layers having bearing properties such as low friction, wear resistance and load carrying capacity and which can be diamond turned may also be used for coating the piston outer diameter.

The method further comprises the steps of forming a compression cylinder sleeve having a longitudinal bore passing therethrough for forming a compression cylinder having a cylinder wall with an inner diameter forming a mating or wear surface for mating with the compression piston outer diameter. The cylinder wall inner diameter is coated with a layer of PTFE based composite material which may be deposited by an electroless nickel plating process and which may have a hardness which is as high as Rc 70. The cylinder wall is then diamond turned to a cylinder final diameter for mating with the piston final diameter. It is noted that other coatings or layers having bearing properties such as low friction, wear resistance, high hardness and load carrying capacity and which can be diamond turned may also be used for coating the cylinder inner diameter.

By use of diamond turning methods, the piston final diameter is preferably be turned to a range of plus or minus 0.0002 inches with respect to a desired piston final diameter, however, other working diameters for the piston final diameter may also be used. Advantageously, the piston final diameter will have a cylindricity of less than or equal to 0.0001 inches Total Indicator Runout (TIR) and a surface finish of less than 8 micro inches Ra. Preferably, the diamond turning methods provide a cylindricity of the piston mating surface less than 0.000020 inches TIR by removing material in increments as small as 0.000005 inches. Here a cylindricity error of less than or equal to 0.0001 inches TIR is defined by a zone formed between two ideal cylindrical surfaces having coincident longitudinal central axes with one having a radius which is 0.0001 inches larger than the other while the average radius of the two cylindrical surfaces is equal to the average radius of piston final diameter. The entire surface of the piston final diameter must therefore fall within the zone formed between the two ideal cylinders.

The cylinder sleeve is also diamond turned, however, the longitudinal bore is sized to fit the piston final diameter. Again a cylindricity error of the cylinder bore is less than 0.0001 inches TIR with a surface finish of less than 10 micro inches Ra. Preferably, the diamond turning methods provide a cylindricity of the cylinder final diameter of less than 0.000020 inches TIR by removing material in increments as small as 0.0000050 inches.

The piston may be used as a gage to determine the cylinder final diameter. As the cylinder final diameter is diamond turned increasing the cylinder bore diameter with each cut, the piston may be inserted into the longitudinal bore to determine the fit. The longitudinal bore is turned to a cylinder final diameter which provides a close interference fit defined by passing the piston through the cylinder bore with a force of 3.0 plus or minus 1.25 pounds force applied at a longitudinal axis of the piston.

The method according to present invention allows the use of an aluminum alloy, e.g. alloy 6061-T6, or a copper alloy, e.g. beryllium copper 25, for either the compression piston substrate or the cylinder sleeve substrate thereby improving the thermal conductivity of each of the compressor elements. The method may also be used with a cylinder sleeve or piston substrate of steel, e.g. 1045 carbon or 01 tool steel, which offer a cost advantage over aluminum, or with other metals, e.g. titanium.

The present invention also provides an improved integrated cryocooler assembly for cooling an electronic device to cryogenic temperatures. Such a device comprises a crankcase for housing a hollow compression piston assembly which is movable within a cylinder sleeve housed within the crankcase. A dewar assembly which is also mounted to the crankcase encloses an electronic device to be cooled in a vacuum space provided to reduce radiative heat load of the electronic device to be cooled. A regenerator assembly including a movable regenerator piston, which is movable within a regenerator cylinder, is also contained or partially contained within the crankcase. A drive motor assembly is coupled to drive both the compression piston assembly and the regenerator piston by a drive coupling. The drive motor and drive coupling are configured to simultaneously drive the compression piston and the regenerator piston 90 degrees out of phase with each other.

Accordingly, the integrated cryocooler includes a compression piston formed from a thermally conductive substrate and which includes an outer diameter coated with a layer of PTFE based composite material, or other material which provides low friction and load carrying capacity, which is diamond turned to a piston final diameter.

The integrated cryocooler assembly further includes an annular compression cylinder sleeve formed from a thermally conductive substrate and which includes a longitudinal bore for receiving the piston outer diameter therein. The longitudinal bore is coated with a layer of PTFE based composite material, or other material which provides low friction and load carrying capacity, which may be deposited by an electroless nickel plating process, which is diamond turned to a cylinder final diameter for mating with the piston final diameter. The longitudinal bore may be turned to a final cylinder diameter which allows the piston to be passed through the cylinder longitudinal bore with a force of 3.0 plus or minus 1.25 pounds force applied at a longitudinal axis of the piston.

BRIEF DESCRIPTION OF THE DRAWINGS

The present invention may best be pointed out with particularity in the appended claims. The above and further advantages of the present invention may be better understood by referring to the following description in conjunction with the accompanying drawings in which:

DETAILED DESCRIPTION OF THE INVENTION

Figure 1A:
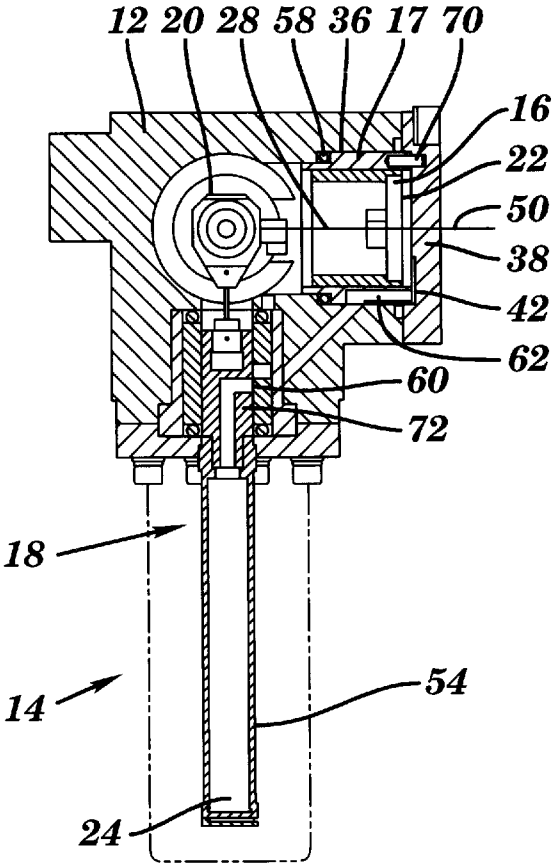
FIG. 1A depicts front sectional view and FIG. 1B depicts a side sectional view of an integral cryocooler detailing the compression piston and compression cylinder as well as the compressor drive motor according to the present invention.
Figure 1B:
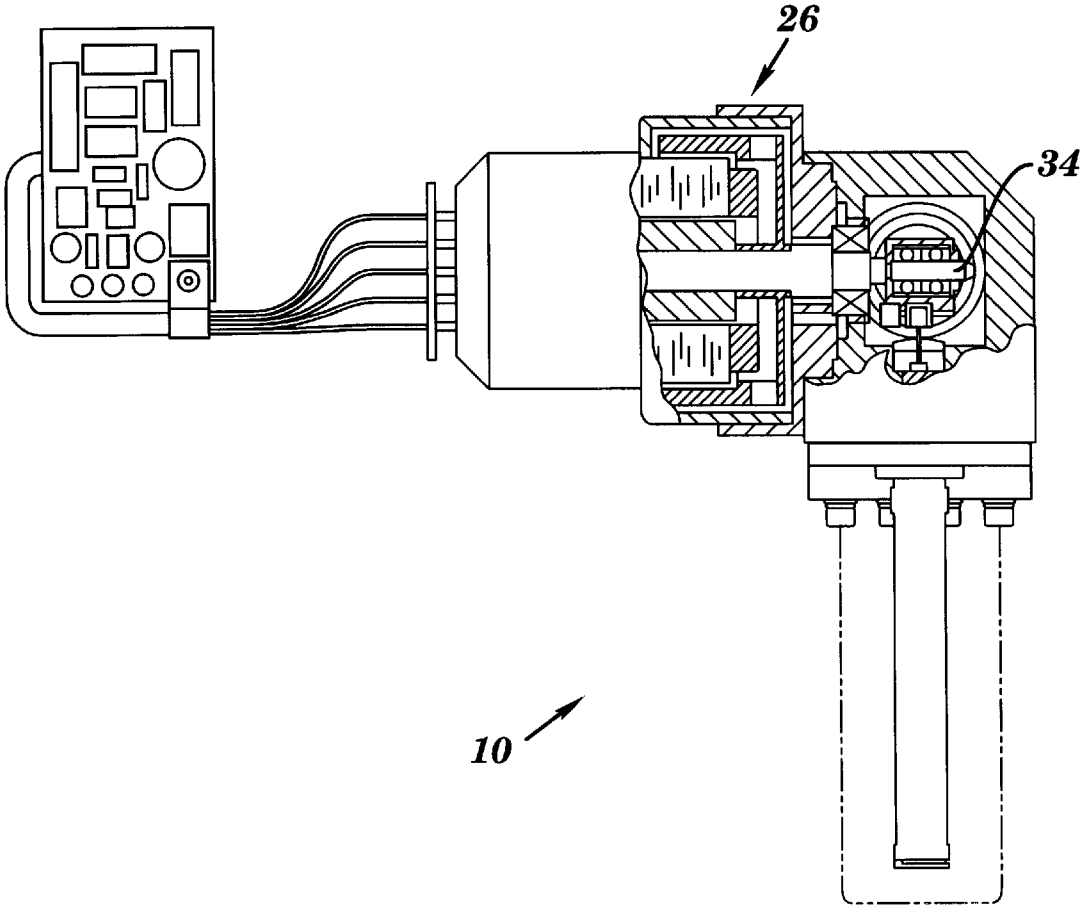

Referring now to FIGS. 1A and 1B there is shown an integral cryocooler according to the present invention and referred to generally as reference numeral 10, and depicted in a front and a side sectional views. The cryocooler 10 includes a crankcase 12, a dewar assembly, generally referred to as reference numeral 14, (shown in phantom), a hollow compression piston assembly 16, which is movable within a cylinder sleeve 17 which is mounted within the crankcase 12. A regenerator assembly, generally referred to as reference numeral 18, includes a movable regenerator piston 72, which is movable within a regenerator cylinder 60. A drive motor assembly referred to generally as reference numeral 26 is coupled to drive both the compression piston assembly 16 and the regenerator piston 72 by a drive coupler 20. The drive motor 26 and drive coupling 20 are configured to simultaneously drive the compression piston 16 and the regenerator piston 72 90 degrees out of phase with each other.

Cryocooler 10 is of the type referred to as a two piston V-form integral Stirling cryocooler. Such a cryocooler is disclosed in commonly assigned U.S. Pat No. 4,858,442, incorporated herein by reference.

Figure 2B:
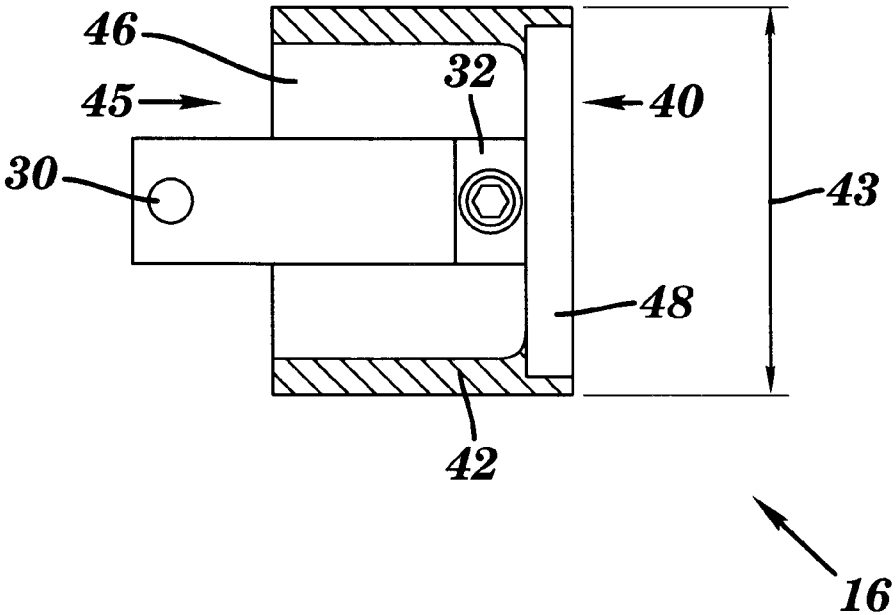
FIG. 2A depicts a front view and FIG. 2B depicts a sectional side view of a compression piston according to the present invention.
Figure 2A:
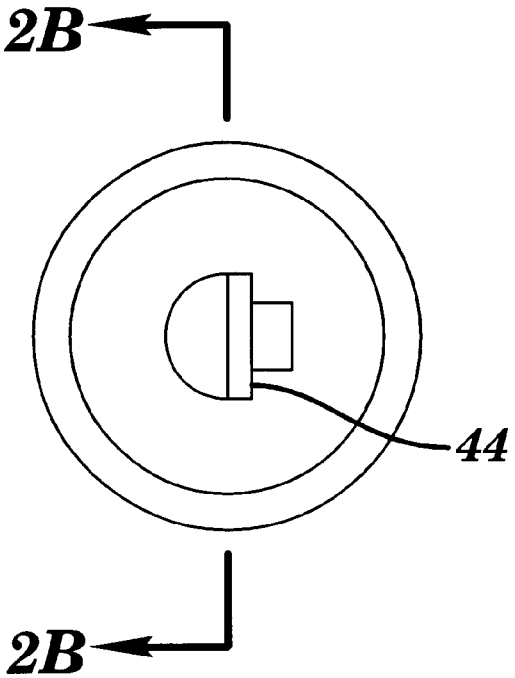
Figure 3A:
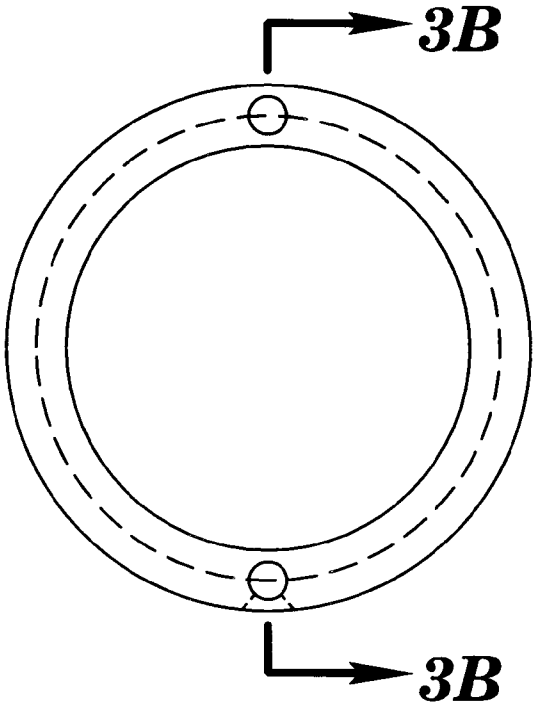
FIG. 3A depicts a front view and FIG. 3B depicts a sectional side view of a cylinder sleeve according to the present invention.
Figure 3B:
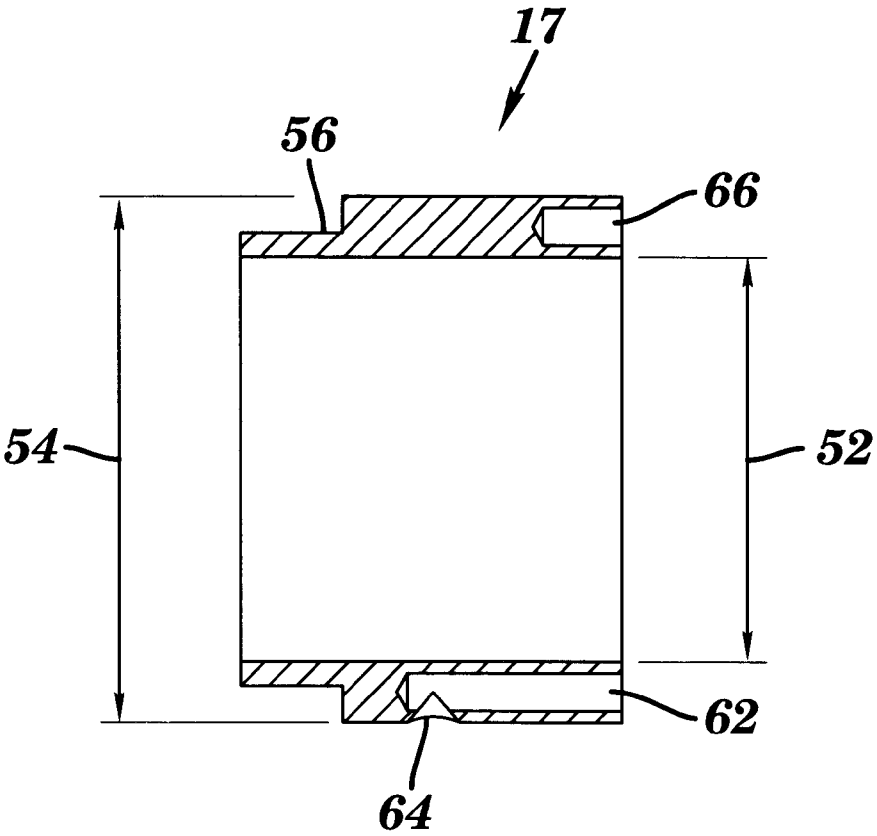
Figure 4B:
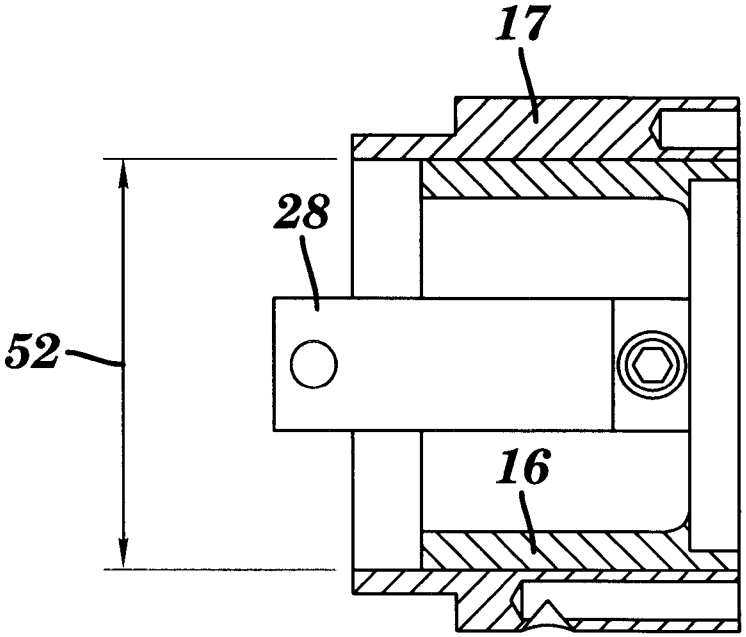
FIG. 4A depicts a front view and FIG. 4B depicts a sectional side view of an assembled compression piston and cylinder sleeve according to the present invention.
Figure 4A:
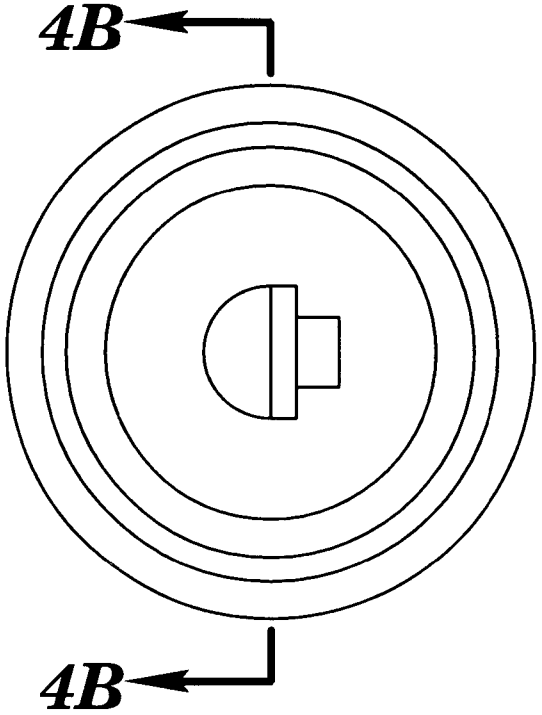

Specifically the compressor piston 16 is coupled to drive coupler 20 through a coupling link 28 which is rotatably mounted to both the drive coupling 20 at a first end 30 and the compression piston 16 at an opposite end 32. (See FIGS. 2A and 2B.) The cylinder sleeve 17 is housed within a bore 36 provided in the crank case 12. A compression cylinder head 38 is fastened to the crankcase 12 and provides a compression space 22 between the compression end 40 of the compression piston 16 and the cylinder head 38. A refrigeration gas is compressed in the compression space 22 which is in communication with a cold well tube 54 through a series of passages 42 which cycle pressurized refrigeration gas through the regenerator assembly 18.

As the drive coupling 20 is rotated by the drive motor assembly 26 the first end 30 of coupling link 28 moves in circle about the motor drive shaft 34 causing the compression piston to cycle in and out of a compression space 22. Due to the circular movement of the first end 30 of coupling link 28, the driving force delivered by the second end 32 of coupling link 28 constantly varies in direction with respect to the axis of motion of the compression piston 16 which moves along a longitudinal axis 50 of a compression cylinder bore 52. This directional variation of the driving force delivered by the coupling link 28 tends to continuously load the compression piston 16 against different areas of the compression cylinder side wall during the drive cycle. This varying load condition makes it critical that the radial gap between the compression piston 16 and the compression cylinder bore 52 be uniform over the entire circumference of the interface.

Referring now to all the Figures, the compression piston 16 comprises an annular outer wall 42 having an outer diameter 43, for mating with a cylinder bore 52, and a hollow interior region provided to reduce the overall mass of the piston. The compression piston 16 includes a piston head 48 for sealing a compression end, referred to generally as reference numeral 40, from a non-compression end, referred to generally as reference numeral 45. A pivot clamp 44 mounts to the piston head 48 on the non-compression end 45 for pivotally connecting with the coupling link 28. On the compression end 40 there is included a hollow cavity 46 formed by the head 48 and the outer wall 42 for providing a portion of the compression space 22.

The outer wall 42 is made sufficiently long so as to maximize a contact area between the outer diameter 43 and the mating cylinder bore 52. This provides reduced wobble of the piston during motion and maximizes a gas film length formed in the radial gap between the mating surface diameters 43 and 52.

Cylinder sleeve 17 comprises an annular member having a longitudinal axis 50 and a cylinder bore 52 for receiving the piston outer diameter 43 such that a radial gap between the mating diameters is maintained during cyclic movement of the piston 16 through the cylinder bore 52. A sleeve outer diameter 54 is sized for a close interference fit with crankcase bore 36. An annular land 56 provides a space for an o-ring 58 which seals the non-compression end 45 of the compressor. A pin 70 is provided in the cylinder sleeve to align the cylinder head 38 with the crankcase 12. A bore 62 and through hole 64 provide a portion of passage 42 which allows refrigeration gas to pass to regenerator assembly 18.

The gas flow through the circumferencial gap between diameter 43 and 52 is modeled as a laminar flow between two parallel plates which is given by equation 1 below:

$$\text{Delta } P=(12QuL)/(h^3S) \quad (1)$$

where Delta P=pressure pulse,

Q=Flow along the gap (leakage);

S=Circumference length;

u=viscosity;

h=the radial gap or clearance; and,

L=piston length.

Here, the flow Q is proportional to the piston velocity and the piston cross-sectional area and the viscosity u is proportional to the gas temperature and the fill pressure of the compression space 22. It can be seen from equation 1 that the pressure pulse Delta P, or gas film stiffness, increases with the cube of the radial clearance in the gap h such that the smaller the radial gap, the stiffer the gas film becomes thereby increasing the gas film force which centers piston diameter 43 within cylinder diameter 52. It can also be seen that variations in the gap uniformity can significantly vary the local gas film stiffness causing non-uniform local loading of the piston against the cylinder wall.

The piston 16 is manufacture according to the present invention as follows. The piston 16 is machined from a substrate, which may be a casting, or the like, and may be formed from alloys of copper, e.g, beryllium copper 25, aluminum, e.g. alloy 6061-T6, steel, e.g. 1045 carbon or 01 tool steel, or from other metals by conventional forming and or turning methods to provide the piston outer diameter 43, the piston head 48 and other piston features shown in FIGS. 2A and 2B. Alternately, the piston substrate may be formed from other metals or it may be formed from other materials which meet the criteria outlined below. Preferable, the substrate material has a high coefficient of thermal conductivity and for the present invention the piston 16 and the cylinder sleeve 17 are advantageously formed from the same material so as to match the coefficient of thermal expansion of the mating parts. In the present invention, piston 16 and sleeve 17 are each formed from an 6061-T6 aluminum which offers increased thermal conductivity over steel, but at increased cost.

The outer diameter 43 is rough machined to provide a diameter which is smaller than the required final diameter. Thereafter, a layer of PTFE based composite material is applied onto the outer diameter 43 to a thickness in the range of 0.005 to 0.015 inches, however, other thicknesses may be applied without deviating from the spirit of the present invention. Such a material is available under the trade name RULON J which is manufactured e.g. by DIXON DIVISION OF FURON of Bristol, R.I., USA. The RULON J is provided in the form of a flexible tape comprising an all-polymeric reinforced PTFE having one surface suitable for bonding to the piston outer diameter. Other PTFE based composite materials may also be used including those which may include a PTFE based composite intermixed with and overlaying a porous metal layer. In present invention a layer of the PTFE based composite tape is bonded onto the surface of the outer diameter 43 such that it substantially covers the entire surface of the piston outer diameter 43 forming a single seam. The RULON J tape or other PTFE based composite material layer provides low friction, wear resistance and load carrying capacity without the use of a wet lubricant. It is also machinable according to the method detailed below. It is noted that any low friction, wear resistant and load carrying material may be used which can be diamond turned according to the requirements detailed below.

After deposition of the PTFE based composite material layer, the piston 16 is mounted in a CNC diamond turning lathe preferably having aerostatics ways and spindles for diamond turning the outer diameter 43. The diameter 43 is machined or diamond turned to a dimension of 0.5480 inches plus or minus 0.0002 inches which is achievable by conventional machining methods, however, since the diamond turning lathe further incorporates laser position feedback methods which are used to remove the PTFE based composite material layer in increments of as small as 0.000005 inches, the geometric accuracy of outer diameter 43 can be maintained to a cylindricity of less than 0.0001 inches TIR and preferably can be turned to a cylindricity of less than or equal to 0.000020 inches TIR. Furthermore, since the PTFE based composite material layer is removed in increments of as small as 0.000005 inches the final surface finish of diameter 43 has a surface roughness which may range from 2–8 micro inches Ra. These geometric accuracy's and surface roughness figures can not be consistently met by the prior art methods detailed above or by any other prior art methods. The actual final diameter 43 is then measured and recorded for mating with a cylinder sleeve 17. Such diamond turning lathes are known in the art and are available from e.g. RANK PNEUMO, a division of Rank-Taylor Hobson Ltd. of Leicestershire England.

The cylinder sleeve 17 is manufacture according to the present invention as follows. The sleeve 17 is formed from a substrate which may be a casting, or the like, and may be formed from alloys of copper, e.g. beryllium copper 25, aluminum, e.g. 6061-T6, steel, e.g. 1045 carbon or 01 tool steel, or other metals by conventional forming and or turning methods to provide the sleeve outer diameter 54, the land feature 56, bore 62, through hole 64 and pin hole 66. Alternately the substrate may be formed from other metals or it may be formed from other materials which meet the criteria outlined below. Preferable, the substrate material has a high coefficient of thermal conductivity and for the present invention the piston 16 and the cylinder sleeve 17 are advantageously formed from the same material so as to match the coefficient of thermal expansion of the mating parts. In the present invention, piston 16 and sleeve 17 are each formed from 6061-T6 aluminum.

The cylinder bore 52 is rough machined to provide a diameter which is larger than the required final diameter. A composite layer comprising nickel, phosphorus and PTFE is then deposited by an electroless chemical deposition process onto the surface of the cylinder bore 52 to a thickness in the range of 0.001 to 0.003 inches, however, another thickness may be applied without deviating from the spirit of the present invention. Such a material is available under the trade name POLYOND which is manufactured and deposited e.g. by POLY PLATING of Chicoppee Mass., USA. POLYOND is a teflon electroless nickel plating material which provides low friction, wear resistance and load carrying capacity, however other low friction wear resistant machinable coatings may also be applied provided that they can be diamond turned according to the requirements detailed below.

The POLYOND process achieves a fusion of polymer resins throughout the thickness of the coating. This generates a continuing action of dry lubricity even as the plating layer wears. The coefficient of friction of a POLYOND surface is 0.06 when measured with a 200 pound kinetic load. The hardness of the POLYOND layer is Rc 50 as applied however, after baking for one hour at 750° C., a hardness of up to Rc 70 is achievable. Plating thicknesses may range from 0.0002 up to 0.003 inches and the thickness can be controlled to plus or minus 0.0001 inches. Furthermore, POLYOND has an operating range of freezing (0° C.) to 288° C.

After deposition of the Nickel/Phosphorus/PTFE layer, the sleeve 17 is mounted in a CNC diamond turning lathe preferably having aerostatics ways and spindles for diamond turning to the final cylinder bore diameter 52. In this case, the final bore dimension is sized to be compatible with a particular mating piston 16 such that a piston and cylinder are manufactured as a match set. This is not a requirement of the invention since the piston outer diameter and the cylinder inner diameter may be turned to closely matching dimension so that non-mating pairs can be used together, however, the use of a matched set can provide a smaller radial gap. The diamond turning lathe may further incorporate laser position feedback methods which are used to remove the POLYOND layer in increments of as small as 0.000005 inches while maintaining the bore geometric accuracy to a cylindricity of less than 0.0001 inches TIR and preferably less than or equal to 0.000020 inches TIR. The final surface finish of the bore 52 is diamond turned to provide a roughness in the range of 4–10 micro inches Ra. Material continues to be removed from the cylinder bore 52 in very small increments until the cylinder diameter provides a close interference fit with the diameter of the mating piston 16. As a test for the final fit of the mating pair, the piston 16 is installed within a mating cylinder bore 52 and a force of 3.0 plus or minus 1.25 pounds of force is applied at a center or longitudinal axis of the piston 16 to force the piston 16 through the cylinder bore 52. It is also noted that the final fit of the piston and cylinder is not limited to a close interference fit but could be a clearance fit or a tighter interference fit depending on the application of the mating pair.

The manufacturing methods of the present invention provide reduced friction due to the lower coefficient of friction provided by the PTFE coatings. They offer an increased gas film stiffness in the radial gap due to providing a smaller radial gap and they provide a more uniform gas film stiffness within the radial gap between the piston 16 and the cylinder sleeve 17 as a result of the more accurate part geometry's provided by the diamond turning methods. The benefits of these improvements include a more efficient cryocooler system. To test the effectiveness of the improvements to a cryocooler unit, a number of tests were performed which compared the performance of a series of cryocooler systems manufactured according to the prior art with a series of cryocooler systems manufactured according to the present invention. The following parameters were measured with the results indicated.

| | |
|---|---|
| Cool down time in minutes | reduced by 9% |
| Cooling power in watts | increased by 3% |
| Input power at 77° K. in watts | reduced by 10% |
| Vibration (peak to peak) in G's | reduced by 11% |
| System efficiency in % | increased by 12% |

It will also be recognized by those skilled in the art that, while the invention has been described above in terms of preferred embodiments, it is not limited thereto. Various features and aspects of the above described invention may be used individually or jointly. Further, although the invention has been described in the context of its implementation in a particular environment, and for particular applications, e.g. an integrated cryocooler assembly, those skilled in the art will recognize that its usefulness is not limited thereto and that the present invention can be beneficially utilized in any number of environments and implementations. Accordingly, the claims set forth below should be construed in view of the full breadth and spirit of the invention as disclosed herein.

What we claim and desire to secure by Letters of Patent of the U.S. are the following:

1. An apparatus for compressing a gas comprising; a compression piston for movement within a compression cylinder, said compression piston being formed from a thermally conductive substrate and including an annular outer wall housing a hollow cavity and a piston head for closing a compression end of the hollow cavity, said annular outer wall further comprising an outer diameter coated with a layer of PTFE based composite material which is diamond turned to a piston final diameter.

2. The apparatus of claim 1 further comprising a compression cylinder sleeve formed from a thermally conductive substrate and including an annular wall having a longitudinal bore passing therethrough for forming the compression cylinder, said longitudinal bore being coated with a PTFE based composite layer which is diamond turned to a cylinder final diameter for mating with the piston final diameter.

3. The apparatus of claim 2 wherein said cylinder final diameter has a cylindricity variation which is less than 0.0001 inches TIR.

4. The apparatus of claim 2 wherein said cylinder final diameter has a surface roughness which is less than 20 micro inches Ra.

5. The apparatus of claim 2 wherein the piston final diameter is selected by passing the piston through the longitudinal bore with a predetermined force applied at a longitudinal axis of the piston.

6. The apparatus of claim 2 wherein the cylinder final diameter is selected by passing the piston through the longitudinal bore with a force of 3.0 plus or minus 1.25 pounds force applied at a longitudinal axis of the piston.

7. The apparatus of claims 2 wherein said thermally conductive substrate comprises an aluminum alloy.

8. The apparatus of claims 2 wherein said thermally conductive substrate comprises a copper alloy.

9. The apparatus of claim 2 wherein the PTFE composite layer further comprises nickel and phosphorus and wherein the PTFE composite layer is deposited by an electroless nickel plating method.

10. The apparatus of claim 1 wherein said piston final diameter has a cylindricity variation which is less than 0.0001 inches TIR.

11. The apparatus of claim 1 wherein said piston final diameter has a surface roughness of less than 8 micro inches Ra.

12. The apparatus of claims 1 wherein the thermally conductive substrate comprises an aluminum alloy.

13. The apparatus of claims 1 wherein said thermally conductive substrate comprises a copper alloy.

14. The apparatus of claim 1 wherein the PTFE composite layer comprises a flexible tape suitable for bonding to the piston outer diameter.

15. The apparatus of claim 14 wherein the flexible tape comprises all-polymeric reinforced PTFE.

16. A method for forming a gas compressing apparatus comprising the steps of:

(a) forming a compression piston from a thermally conductive substrate which includes an annular outer wall housing a hollow cavity and a piston head for closing a compression end of the hollow cavity, said annular wall forming a piston outer diameter;

(b) coating the piston outer diameter with a layer of PTFE based composite material; and, (c) diamond turning the piston outer diameter to a final piston diameter.

17. A method according to claim 16 further comprising the steps of:

(a) forming a compression cylinder sleeve from a thermally conductive substrate by forming an annular wall having a longitudinal bore passing therethrough for forming a compression cylinder having a cylinder wall for receiving the compression piston therein;

(b) coating the cylinder wall with a PTFE based composite layer; and, (c) diamond turning the longitudinal bore to a cylinder final diameter for mating with the piston final diameter.

18. A method according to claim 17 wherein the step of diamond turning the cylinder final diameter further includes the step of turning the final cylinder diameter to a cylindricity of less than 0.0001 inches TIR.

19. A method according to claim 17 wherein the step of diamond turning the cylinder final diameter further includes the step of turning the final cylinder diameter to a surface roughness of less than or equal to 10 micro inches Ra.

20. A method according to claim 17 further comprising the steps of:

(a) turning the piston final diameter to within a range of plus or minus 0.0002 inches of a desired piston final diameter; and (b) turning the longitudinal bore to a cylinder final diameter said cylinder final diameter being determined by passing the piston through the longitudinal bore with a predetermined force applied at a longitudinal axis of the piston.

21. A method according to claim 17 further comprising the steps of:

(a) turning the piston final diameter to within a range of plus or minus 0.0002 inches of a desired piston final diameter; and (b) turning the longitudinal bore to a cylinder final diameter which is determined by passing the piston through the longitudinal bore with a force of 3.0 plus or minus 1.25 pounds force applied at a longitudinal axis of the piston.

22. A method according to claim 17 wherein the step of forming a compression cylinder sleeve from a thermally conductive substrate comprises forming the compression cylinder sleeve from an aluminum alloy.

23. A method according to claim 17 wherein the step of forming a compression cylinder sleeve from a thermally conductive substrate comprises forming the compression cylinder sleeve from a copper alloy.

24. A method according to claim 16 wherein the step of diamond turning the piston outer diameter further includes the step of turning the final piston diameter to a cylindricity of less than 0.0001 inches TIR.

25. A method according to claim 16 wherein the step of diamond turning the piston outer diameter further includes the step of turning the final piston diameter to a surface roughness of less than or equal to 8 micro inches Ra.

26. A method according to claim 16 wherein the step of forming a compression piston from a thermally conductive substrate comprises forming the piston from an aluminum alloy.

27. A method according to claim 16 wherein the step of forming a compression piston from a thermally conductive substrate comprises forming the piston from a copper alloy.

28. The method according to claim 16 wherein the step of coating the piston outer diameter with a layer of PTFE comprises bonding a flexible tape onto the piston outer diameter.

29. The method according to claim 16 wherein the step of coating the cylinder wall with a PTFE based composite layer further comprises the step of depositing a nickel, phosphorus, PTFE composite layer by an electroless nickel plating method.

30. A method for forming a mating piston and cylinder sleeve wherein the piston includes an outer diameter and a cylinder sleeve includes a bore for receiving the piston therein and wherein the piston outer diameter and the bore each form bearing surfaces comprising the steps of:

(a) coating the piston outer diameter with a layer of PTFE based composite material;

(b) diamond turning the piston outer diameter to a final piston diameter;

(c) coating the cylinder wall with a PTFE based composite layer; and, (d) diamond turning the longitudinal bore to a cylinder final diameter for mating with the piston final diameter.

31. A method according to claim 30 wherein the step of diamond turning the piston outer diameter further includes the step of turning the final piston diameter to a cylindricity of less than 0.0001 inches TIR.

32. A method according to claim 30 wherein the step of diamond turning the cylinder final diameter further includes the step of turning the final cylinder diameter to a cylindricity of less than 0.0001 inches TIR.

33. A method according to claim 30 wherein the step of diamond turning the piston outer diameter further includes the step of turning the final piston diameter to a surface roughness of less than or equal to 8 micro inches Ra.

34. A method according to claim 30 wherein the step of diamond turning the cylinder final diameter further includes the step of turning the final cylinder diameter to a surface roughness of less than or equal to 10 micro inches Ra.

35. A method according to claim 30 further comprising the steps of:

(a) turning the piston final diameter to within a range of plus or minus 0.0002 inches of a desired piston final diameter; and (b) turning the longitudinal bore to a cylinder final diameter said cylinder final diameter being determined by passing the piston through the longitudinal bore with a predetermined force applied at a longitudinal axis of the piston.

36. A method according to claim 30 further comprising the steps of:

(a) turning the piston final diameter to within a range of plus or minus 0.0002 inches of a desired piston final diameter; and (b) turning the longitudinal bore to a cylinder final diameter which is determined by passing the piston through the longitudinal bore with a force of 3.0 plus or minus 1.25 pounds force applied at a longitudinal axis of the piston.

37. The method according to claim 30 wherein the step of coating the piston outer diameter with a layer of PTFE based composite material comprises bonding a layer flexible tape onto the piston outer diameter.

38. The method according to claim 30 wherein the step of coating the cylinder wall with a PTFE based composite layer further comprises the step of depositing a nickel, phosphorus PTFE composite layer by an electroless nickel plating method.

39. An integrated cryocooler assembly for cooling an electronic device to cryogenic temperatures comprising:

(a) a crankcase for housing a compressor, a hollow compression piston assembly which is movable within a cylinder sleeve for forming the compressor;

(b) a regenerator assembly, including a movable regenerator piston which is movable within a regenerator cylinder at least partially contained within the crankcase;

(c) a drive motor assembly, connected to the crankcase which is coupled to drive both the compression piston assembly and the regenerator piston by a drive coupling, the drive motor and drive coupling being configured to simultaneously drive the compression piston and the regenerator piston 90 degrees out of phase with each other; and, (d) wherein said compression piston is formed from a thermally conductive substrate including an outer diameter coated with a layer of PTFE based composite material which is diamond turned to a piston final diameter.

40. The integrated cryocooler assembly of claim 39 wherein said cylinder sleeve comprises a longitudinal bore for forming the compression cylinder for receiving the compression piston therein, said longitudinal bore being coated with layer of PTFE based composite layer which is diamond turned to a cylinder final diameter for mating with the piston final diameter.

* * * * *